US006785484B2

(12) United States Patent
Nishiyama

(10) Patent No.: US 6,785,484 B2
(45) Date of Patent: Aug. 31, 2004

(54) IMAGE FORMING APPARATUS USING COPY SPEED TO CONTROL FIXING TEMPERATURE

(75) Inventor: Ryuji Nishiyama, Mitaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/914,875

(22) PCT Filed: Mar. 17, 2000

(86) PCT No.: PCT/JP00/01650

§ 371 (c)(1),
(2), (4) Date: Dec. 27, 2001

(87) PCT Pub. No.: WO00/55696

PCT Pub. Date: Sep. 21, 2000

(65) Prior Publication Data

US 2003/0161648 A1 Aug. 28, 2003

(30) Foreign Application Priority Data

Mar. 18, 1999 (JP) ..... 11-072966

(51) Int. Cl.[7] ..... G03G 15/20
(52) U.S. Cl. ..... 399/68; 399/69; 399/400
(58) Field of Search ..... 399/43, 67, 68, 399/69, 396, 397, 400, 322

(56) References Cited

U.S. PATENT DOCUMENTS 4,348,102 A * 9/1982 Sessink ..... 399/68
5,289,247 A * 2/1994 Takano et al. ..... 399/68
5,875,373 A * 2/1999 Sato et al. ..... 399/68
6,108,500 A 8/2000 Ohkama et al.

FOREIGN PATENT DOCUMENTS

| | | | |
|---|---|---|---|
| JP | 04-057067 | * | 2/1992 |
| JP | 04-086678 | * | 3/1992 |
| JP | 04-174457 | * | 6/1992 |
| JP | 06-027855 | * | 2/1994 |
| JP | 06-186875 | * | 7/1994 |
| JP | 07-191571 | * | 7/1995 |
| JP | 08-286549 | * | 11/1996 |
| JP | 09-080968 | * | 3/1997 |
| JP | 10-186946 | | 7/1998 |

* cited by examiner

*Primary Examiner*—Sandra L. Brase
(74) *Attorney, Agent, or Firm*—Rabin & Berdo, P.C.

(57) ABSTRACT

It is to provide an image forming apparatus capable of reducing a processing time and of forming an image without high-temperature offset and defect of fixing when images are continuously formed. The image forming apparatus has number of sheets storing means for storing the number of passing sheets upon previous continuous-image-formation; counter means for counting a passing time from the end time of the continuous image formation; and a CPU for, when the images are continuously formed at this time, limiting the number of sheets image-formed at a first copying speed at which the number of sheets is large per unit time to a predetermined number of sheets, based on the number of recorded sheets and the passing time upon the previous continuous-image-formation and for, when the number of sheets is over the limited number of sheets, changing the first copying speed to the second copying speed at which the number of sheets per unit time is small.

8 Claims, 7 Drawing Sheets

FIG. 3

| TIME T / NUMBER X OF SHEETS | $T < T_1$ (30s) | $T_1 \leq T < T_2$ (60s) | $T_2 \leq T < T_3$ (90s) | $T > T_3$ |
|---|---|---|---|---|
| $X \leq A_1$ (30) SHEETS | TO C (20) SHEETS 1ST cpm | TO F (50) SHEETS 1ST cpm | → | → |
| $A_1 < X \leq A_2$ (50) SHEETS | TO D (10) SHEETS 1ST cpm | TO C (20) SHEETS 1ST cpm | TO F (50) SHEETS 1ST cpm | → |
| $X > A_2$ | TO E (1) SHEET 1ST cpm | TO D (10) SHEETS 1ST cpm | TO C (20) SHEETS 1ST cpm | F (50) SHEETS 1ST cpm |

IMAGE FORMING APPARATUS USING COPY SPEED TO CONTROL FIXING TEMPERATURE

TECHNICAL FIELD

The present invention relates to an image forming apparatus such as an electrophotography copy machine or an electrostatic recording apparatus, and more particularly, to an image forming apparatus for recording a toner image transferred onto a recorded sheet by heating and fixing the toner image.

BACKGROUND OF THE INVENTION

Hitherto, there are copy machines for fixing a toner image to a recorded sheet by using a fixing roller which is heated. In the copy machines, a continuous copying operation causes the quantity of heat taken by the recorded sheet to be increased in proportion to the number of passing recorded sheets. Thus, a surface temperature of the fixing roller is gradually decreased because of the shortage of heat supplied by a heater in the fixing roller. FIG. 8 is a diagram showing change, with time, in a surface temperature of the fixing roller in the conventional copying machine. Referring to FIG. 8, a curve e shows change, with time, in the surface temperature of a sheet passage unit in the fixing roller, and a curve f shows change in a sheet non-passage unit with time. Herein, the sheet passage unit corresponds to a portion of the fixing roller which comes into contact with the recorded sheet and the sheet non-passage unit corresponds to a portion of the fixing roller which does not come into contact with the recorded sheet. During a period T0 of time in FIG. 8, a standby mode of the copying machine is shown. As shown in FIG. 8, at a time tx, staring the continuous copying operation, with passing time, that is, with the increase in number of copied sheets, the surface temperature of the sheet passage unit of the fixing roller is reduced. When the surface temperature of the sheet passage unit is reduced to a prescribed temperature or less, toner on the recorded sheet cannot be melted by heat, thereby making it impossible to fixing the toner. To prevent the failure of fixing the toner, power to be applied to a fixing heater may be increased. However, by using the method, power consumption over the copying machine is increased and, then, the copying machine is unavailable for a home power supply. Consequently, there is an inconvenience in that a set place of the copying machine is limited.

Then, conventionally, the countermeasures are taken against the inconvenience as follows. In other words, a temperature detecting element detects a surface temperature of the fixing roller, and when the surface temperature of the fixing roller is reduced to be less than the prescribed value, a copying process is intermitted and the apparatus is in the standby mode until the surface temperature of the fixing roller is returned to be a predetermined temperature.

However, according to the conventional method, when the surface temperature of the fixing roller is reduced to a prescribed value (lower limit value) or less during the continuous copying operation, the copying operation is interrupted halfway of the continuous copying operation and an operator waits for a state in which the surface temperature of the fixing roller recovers to the predetermined temperature. As a consequence, the conventional method has a problem to take a long time for the continuous copying operation.

Also, in the conventional copying machine, upon continuous copying operation, it is difficult to keep a distribution of the temperature of the fixing roller in the longitudinal direction uniform. This is remarkable when only a single heater for heating the fixing roller and only a single temperature detecting element for detecting the surface temperature of the fixing roller can be provided in terms of costs. That is, in a fixing device having a plurality of light-emitting-type heaters, the change in surface temperature of the fixing roller in the longitudinal direction can be reduced as much as possible by finely controlling light-on timings of the plurality of heaters having different light distributions. On the contrary, in the case of using only the single heater, obviously, the light distribution is fixed and, therefore, the distribution of the temperature of the fixing roller in the longitudinal direction cannot be keep uniform only by the on/off control. The temperature detecting element detects only a temperature nearby the portion against which the temperature detecting element abuts. Therefore, the temperature nearby the portion in which the temperature detecting element is provided is controlled so as to be the predetermined temperature and, however, the temperature excluding the above portion becomes too much higher or too much lower. For example, in the case of continuous passage of post cards, as a recorded sheet, having a width much smaller than that of the fixing roller, heat of the sheet passage unit, in the fixing roller, through which the recorded sheet continuously passes, is lost by the post cards, thereby decreasing the temperature. On the other hand, it is known that since the sheet non-passage unit is heated without loss of heat, the temperature therein increases. In this case, the temperature of the sheet non-passage unit is too much increased if the sheet passage unit is kept to have a proper fixing temperature. Consequently, when the next recorded sheet having a larger size passes, excessive melting is seen in the toner on the recorded sheet passing through the portion of the fixing roller having a higher temperature. If the toner is excessively melt, the viscosity of the toner is decreased and the toner is attached to the fixing roller without fixing to the recorded sheet. A phenomenon of so-called high-temperature offset occurs. On the other hand, if the sheet non-passage unit without the passage of the small-sized recorded sheet is to be kept to be a proper fixing temperature, the temperature of the sheet passage unit becomes too much low whereupon the toner cannot be melt and a phenomenon of a fixing defect is caused.

To prevent the above-mentioned inconvenience, the conventional apparatus controls (deceleration-controls) the number of passing sheets per time so as to be reduced in the halfway by prolonging interval between the conveyed recorded sheets while making a speed for image formation (process speed) constant at a timing of the passage of a predetermined number of sheets during the continuous copying operation or at a timing after a predetermined time. Thus, a difference of the surface temperature of the fixing roller in the longitudinal direction is controlled so as to be within an allowable range of a predetermined temperature.

However, in the conventional apparatus, if repeatedly executing an operation for allowing the recorded sheet having a small width such as a post card, to continuously passing and for ending the copying operation just before the deceleration control, the deceleration control cannot be performed in spite of increasing the difference of the surface temperature of the fixing roller in the longitudinal direction. As a consequence, there is a problem to cause the phenomenon of the high-temperature offset or defect of the fixing.

The present invention is devised in terms of the above circumstances and has its object to provide an image forming apparatus capable of reducing an image forming time, of preventing the surface temperature of the fixing roller from being out of the allowable predetermined temperature range, and of forming the image without the high-temperature offset and defect of the fixing, upon continuously image formation.

SUMMARY OF THE INVENTION

To accomplish the above-mentioned object, according to the present invention, there is provided an image forming apparatus including thermal fixing means having a fixing roller and heating means for heating the fixing roller, temperature detecting means for detecting a temperature of the fixing roller, and temperature control means for controlling power supplied to the heating means and controlling the temperature of the fixing roller based on a signal from the temperature detecting means, characterized by comprising: number of sheets storing means for storing the number of passing sheets upon previous continuous-image-formation; counter means for counting a passing time from the end time of the image formation; and control means for, upon this continuous-image-formation, based on the number of sheets stored by the number of sheets storing means and the time counted by the counter means, limiting the number of sheets image-formed at a first copying speed, at which the number of passing sheets per unit time is large, to a predetermined number of sheets, and for, when the number of sheets is over the limited number of sheets, changing the first copying speed to a second copying speed at which the number of passing sheets per unit time is small.

BRIEF DESCRIPTION OF THE DRAWINGS

FIG. 3 is a table for determining the number of copied sheets at a first copying speed based on a passing time T from the end time of copying operation and the number X of copied sheets at the previous time;

DETAILED DESCRIPTION OF THE INVENTION

Figure 1:
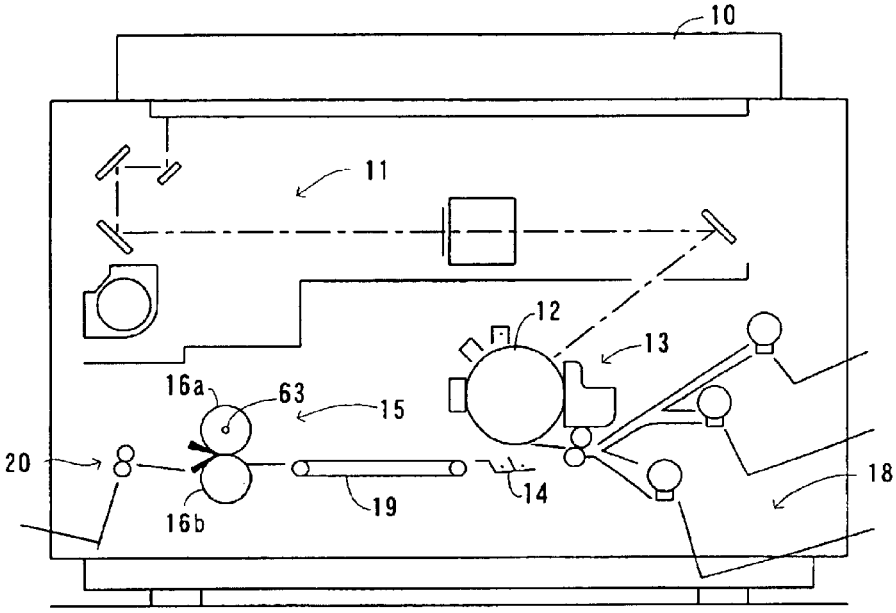
FIG. 1 is a diagram schematically showing the structure of an image forming apparatus according to one embodiment of the present invention.

Hereinbelow, one embodiment of the present invention will be described with reference to the drawings. FIG. 1 is a diagram schematically showing the structure of an image forming apparatus according to the embodiment of the present invention. An image forming apparatus shown in FIG. 1 comprises: an exposure optical system 11 for exposing an original placed on an original plate 10; a photosensitive body 12 for forming an electrostatic latent image onto a surface by reflection light from the exposure optical system 11; a developing device 13 for visibly forming the electrostatic latent image of the photosensitive body 12; a transfer device 14 for transferring a toner image visibly formed on the photosensitive body 12 onto a recorded sheet; and a thermal fixing device 15 for fixing the transferred toner image onto the recorded sheet. The thermal fixing device 15 comprises: a fixing roller 16*a* for which a heater 63 for heating is provided; and a pressing roller 16*b* which abuts against the fixing roller 16*a* on pressure. According to the present embodiment, a supply unit 18 for the recorded sheet and a discharge unit 20 for the recorded sheet are provided.

Figure 2:
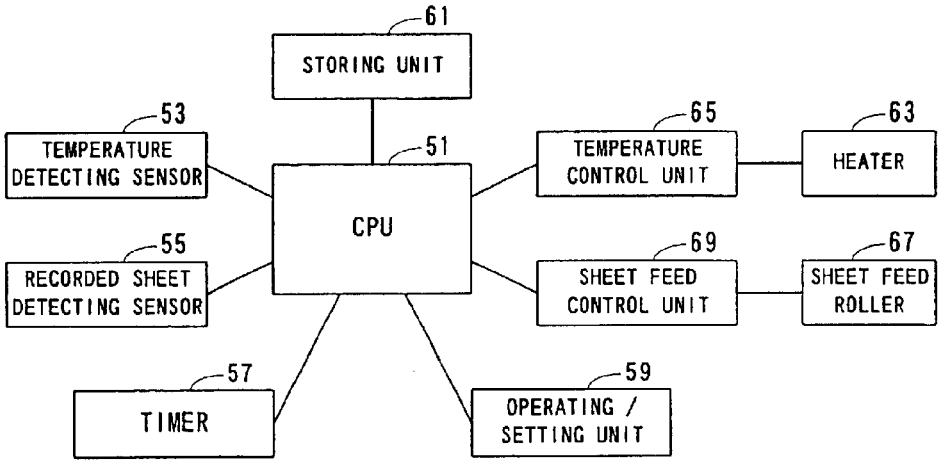
FIG. 2 is a block diagram schematically showing a control unit according to the present embodiment.

FIG. 2 is a block diagram schematically showing the control unit of the image forming apparatus according to the present embodiment. The control unit in the image forming apparatus shown in FIG. 2 comprises: a CPU 51 for controlling the overall copying machine by reading and executing a control program from a ROM (not shown); a temperature detecting sensor 53 arranged substantially in the center of the fixing roller 16*a*, for detecting the surface temperature of the fixing roller; a recorded sheet detecting sensor 55 for detecting the recorded sheet which passes through the thermal fixing device 15; a timer 57 for counting a passing time from the end time of the copying operation; an operating/setting unit 59; a storing unit 61 for storing a table, which will be described later, and the like; a temperature control unit 65 for controlling a power supplied to a heater 63 in accordance with an instruction from the CPU 51; and a sheet feed control unit 69 for controlling the number of sheets passing through the fixing roller per unit time, that is, a copying speed by controlling a sheet feed timing of a sheet feed roller 67 in accordance with the instruction from the CPU 51. In the present embodiment, the sheet feed control unit 69 can change two-stage copying speeds. In the case of selecting a first copying speed, at such a copying speed that the difference of the surface temperature of the fixing roller in the longitudinal direction is soon out of the allowable predetermined temperature range upon the continuous copying operation, for example, 30 recorded sheets are conveyed every minute. In the case of selecting a second copying speed, at such a copying speed that the difference of the surface temperature of the fixing roller in the longitudinal direction is within the allowable predetermined temperature range upon the continuous copying operation, for example, 15 recorded sheets are conveyed every minute. Incidentally, the operating/setting unit 59 has various buttons for instructing commands of operations of copy jobs such as start and stop and a setting button for setting the number of continuously copied sheets.

FIG. 3 is a table for determining the number of copied sheets at the first copying speed based on a passing time T from the end time of the copying operation and a number X of copied sheets at the previous time. This table is stored in the storing unit 61 in a table format. The CPU 51 determines the number of copied sheets at the first copying speed by referring to the table in FIG. 3 and, if the number of copied sheets is over the determined number of copied sheets, the excess sheets are copied at the second copying speed. For instance, if the passing time T from the end time of the copying operation is shorter than T1 (30 sec) and the number of copied sheets at the previous time is not greater than A1 (30), C (20) sheets are continuously copied at the first copying speed and 21st and sequent sheets are continuously copied at the second copying speed. If the passing time T from the end time of the copying operation is shorter than T1 (30 sec) and the number of copied sheets at the previous time is greater than A1 (30) and is not greater than A2 (50), D (10) sheets are continuously copied at the first copying speed and 11th and sequent sheets are continuously copied at the second copying speed. Further, if the passing time T from the end time of the copying operation is not longer than T1 (30 sec) and the number of copied sheets at the previous time is greater than A2 (50), E (1) sheet is copied at the first copying speed and 2nd and sequent sheets are continuously copied at the second copying speed. Incidentally, in the table shown in FIG. 3, for the sake of apparent understanding, the copying speed is shown by arrows under the same condition.

Figure 4:
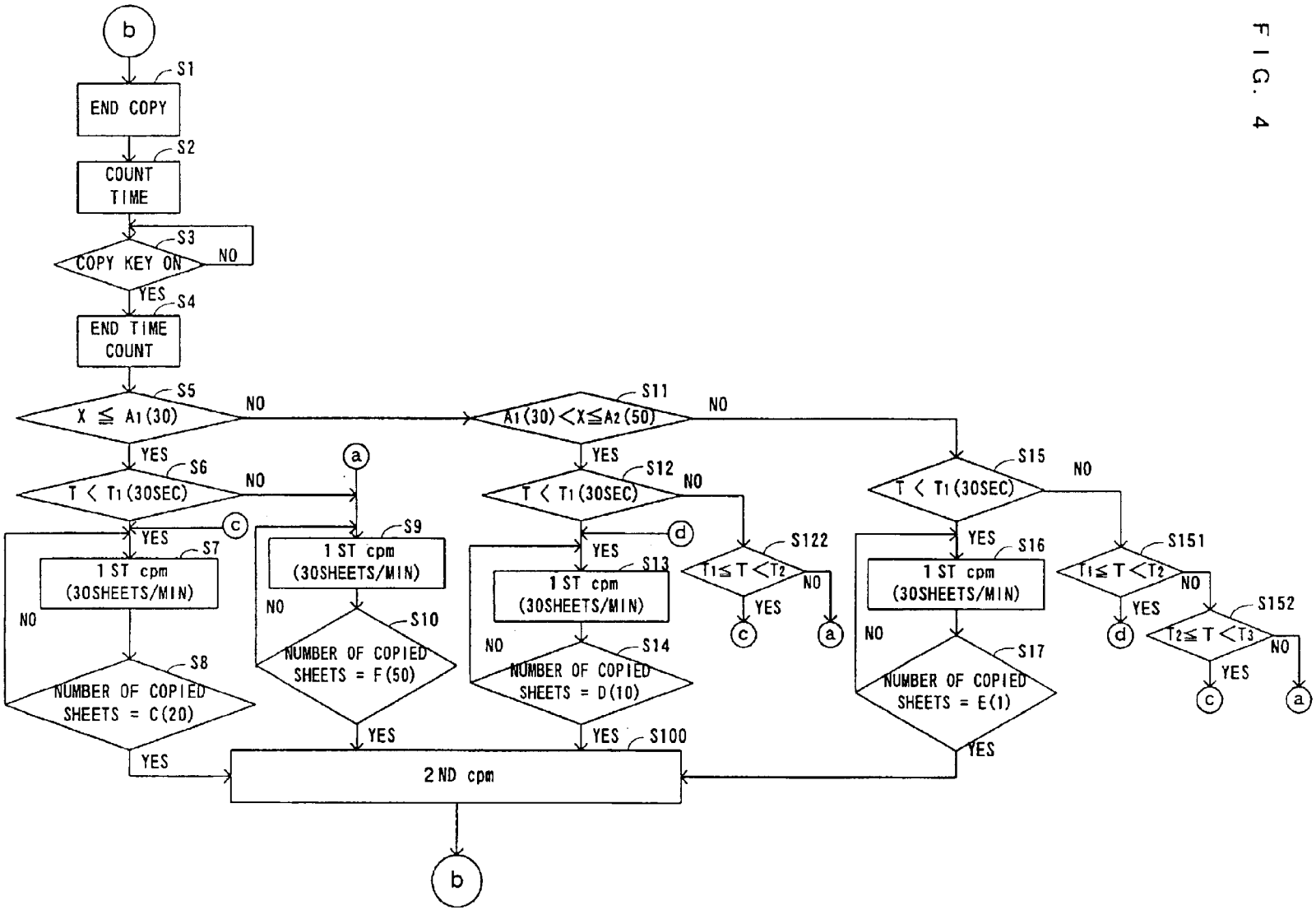
FIG. 4 is a flowchart according to the present embodiment.

Next, an operation in the present embodiment will be described with reference to FIG. 4. FIG. 4 is a flowchart of the operation of the image forming apparatus in the present embodiment. In step S1, the CPU performs a process for ending the copying operation such as a process for resetting the number of continuously copied sheets which is set by an operator and a value of the timer. Next, the timer 57 starts to count time from the end of the copying operation (step S2). When the operator sets the number of next continuously copied sheets and the CPU checks the start of the copying operation (step S3), the timer 57 ends the counting operation in step S4. In step S5, it is determined whether or not the number X of copied sheets at the previous time, which is stored in the storing unit, is A1 (30) or less. If the number of copied sheets at the previous time is A1 (30) or less, the processing routine advances to step 56 whereupon it is determined whether or not the passing time T from the previous end time of the copying operation, that is, the value T of the timer is shorter than T1 (30 sec). If the value T of the timer is shorter than T1 (30 sec), the CPU 51 refers to the table shown in FIG. 3, reads the number of continuously copied sheets at the first copying speed (in this case, C sheets), and starts to continuously copy the sheets (step S7). In step S8, it is checked to see if the number of continuously copied sheets at the first copying speed reaches C (20). After it is determined that the number of continuously copied sheets at the first copying speed reaches 20, the processing routine shifts to step S100 whereupon 21st and sequent sheets are copied at the second copying speed. If ending the copying operation of the number of continuously copied sheets, which is set by the operator, the processing routine returns to step S1 whereupon the above-mentioned end process of the copying operation is executed.

On the other hand, if it is determined in step S6 that the value T of the timer is T1 (30 sec) or longer, the CPU 51 refers to the table shown in FIG. 3, reads the number of continuously copied sheets at the first copying speed (in this case, F sheets), and starts to continuously copy the sheets (step S9). In step S10, it is checked to see if the number of continuously copied sheets at the first copying speed reaches F (50). After it is determined that the number of continuously copied sheets at the first copying speed reaches 50, the processing routine shifts to step S100 whereupon 51st and sequent sheets are copied at the second copying speed which is switched from the first copying speed. The operator completes the operation for copying the number of continuously copied sheets, which is set by the operator and, then, the processing routine returns to step S1.

If it is determined in step S5 that the number X of copied sheets at the previous time is greater than A1 (30), the processing routine advances to step S11 whereupon it is determined whether or not the number X of copied sheets at the previous time is 50 or less. If the number X of copied sheets at the previous time is greater than A1 (30) and is not greater than 50, the processing routine advances to step S12 whereupon it is determined whether or not the passing time from the previous end time of the copying operation, that is, the value T of the timer is shorter than T1 (30 sec). If it is determined that the value T of the timer is shorter than T1 (30 sec), the CPU 51 refers to the table shown in FIG. 3, reads the number of continuously copied sheets at the first copying speed (in this case, D sheets), and starts to continuously copy the sheets (step S13). In step S14, it is checked to see if the number of continuously copied sheets at the first copying speed reaches D (10). After it is determined that the number of copied sheets at the first copying speed reaches 10, the processing routine shifts to step S100 whereupon 11th and sequent sheets are copied at the second copying speed which is switched from the first copying speed. The operator completes the operation for copying the number of continuously copied sheets, which is set by the operator, and, then, the processing routine returns to step S1 whereupon the above-mentioned copying end process is implemented.

If it is determined in step S12 that the value T of the timer is T1 (30 sec) or longer, the processing routine shifts to step S122 whereupon it is determined whether or not T is T1 (30 sec) or longer and is shorter than T2 (60 sec). If it is determined that T is T1 or longer and is shorter than T2, the CPU 51 refers to the table shown in FIG. 3, reads the number of continuously copied sheets at the first copying speed (in this case, C sheets), and starts to continuously copy the sheets (step S7). In step S8, it is checked to see if the number of continuously copied sheets at the first copying speed reaches C (20). After it is determined that the number of copied sheets at the first copying speed reaches 20, the processing routine shifts to step S100 and the above-mentioned process is executed. On the other hand, it is determined in step S122 that T is T2 or longer, the CPU 51 refers to the table shown in FIG. 3, reads the number of continuously copied sheets at the first copying speed (in this case, F sheets), and starts to continuously copy the sheets (step S9). In step S10, it is checked to see if the number of continuously copied sheets at the first copying speed reaches F (50). After it is determined that the number of copied sheets at the first copying speed reaches 50, the processing routine shifts to step S100 and the above-mentioned process is executed.

If it is determined in step S11 that the number X of copied sheets at the previous time is greater than A2 (50), the processing routine advances to step S15 whereupon it is determined whether or not the passing time T from the previous end time of the copying operation is shorter than T1 (30 sec). If it is determined that the value T of the timer is shorter than T1 (30 sec), the CPU 51 refers to the table shown in FIG. 3, reads the number of continuously copied sheets at the first copying speed (in this case, E sheets), and starts to continuously copy the sheets (step S16). In step S17, it is checked to see if the number of continuously copied sheets at the first copying speed reaches E (1). After it is determined that the number of copied sheets at the first copying speed reaches 1, the processing routine shifts to step S100 and the above-mentioned process is executed. If it is determined in step S15 that T is T1 (30 sec) or longer, and the processing routine shifts to step S151 whereupon it is determined whether or not T is T1 or longer and is shorter than T2 (60 sec). If it is determined that T is T1 or longer and is shorter than T2, the processing routine shifts to step S13 and the above-mentioned process is executed. On the other hand, if it is determined in step S151 that T is T2 or longer, the processing routine shifts to step S152 whereupon T is T2 or longer and is shorter than T3 (90 sec). If it is determined that T is T2 or longer and is shorter than T3, the processing routine shifts to step S7 and the above-mentioned process is executed. If it is determined in step S152 that T is T3 or longer, the processing routine shifts to step S9 and the above-mentioned process is performed.

Figure 5:
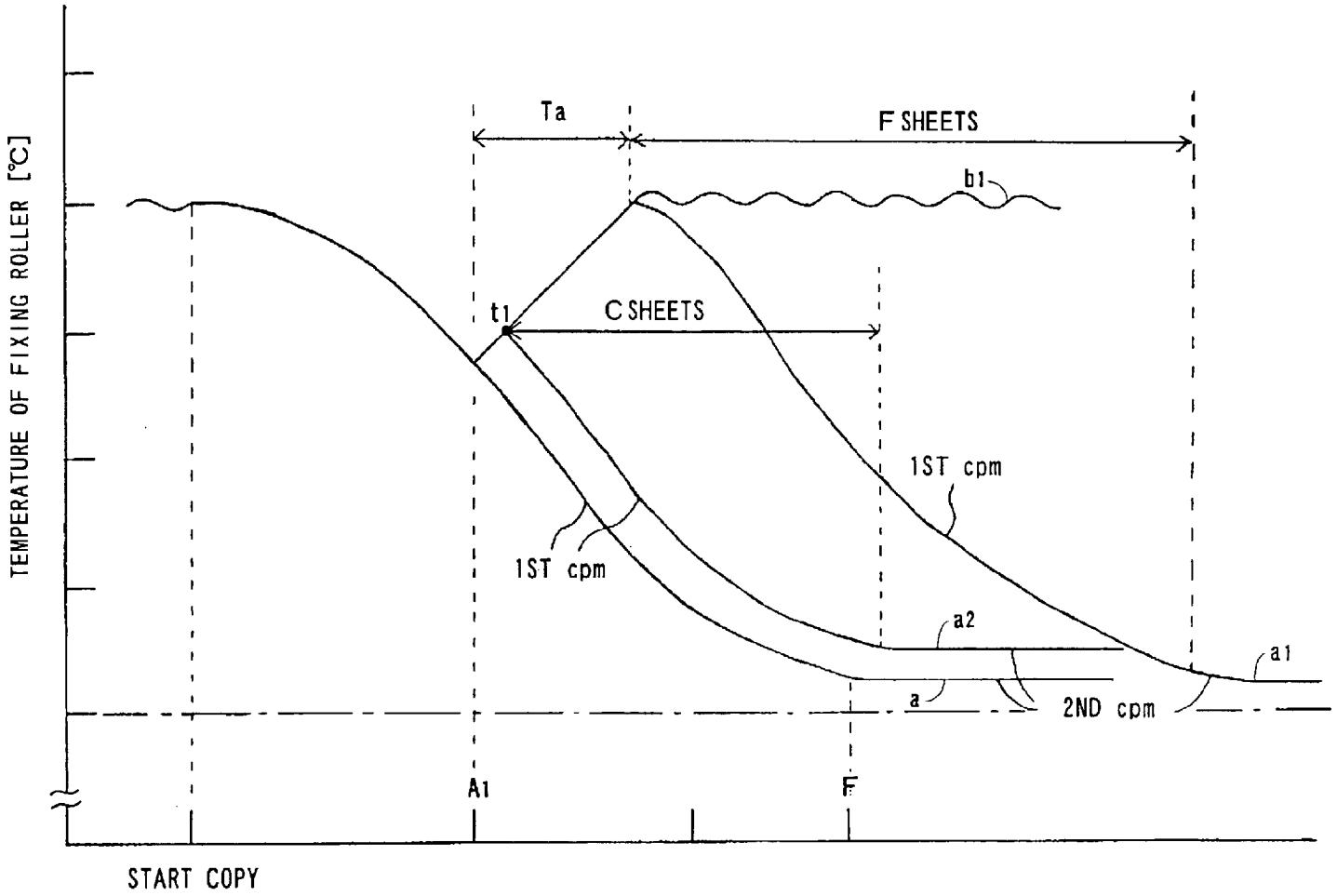
FIG. 5 is a diagram showing change, with time, in surface temperature of a fixing roller according to the present embodiment.
Figure 6:
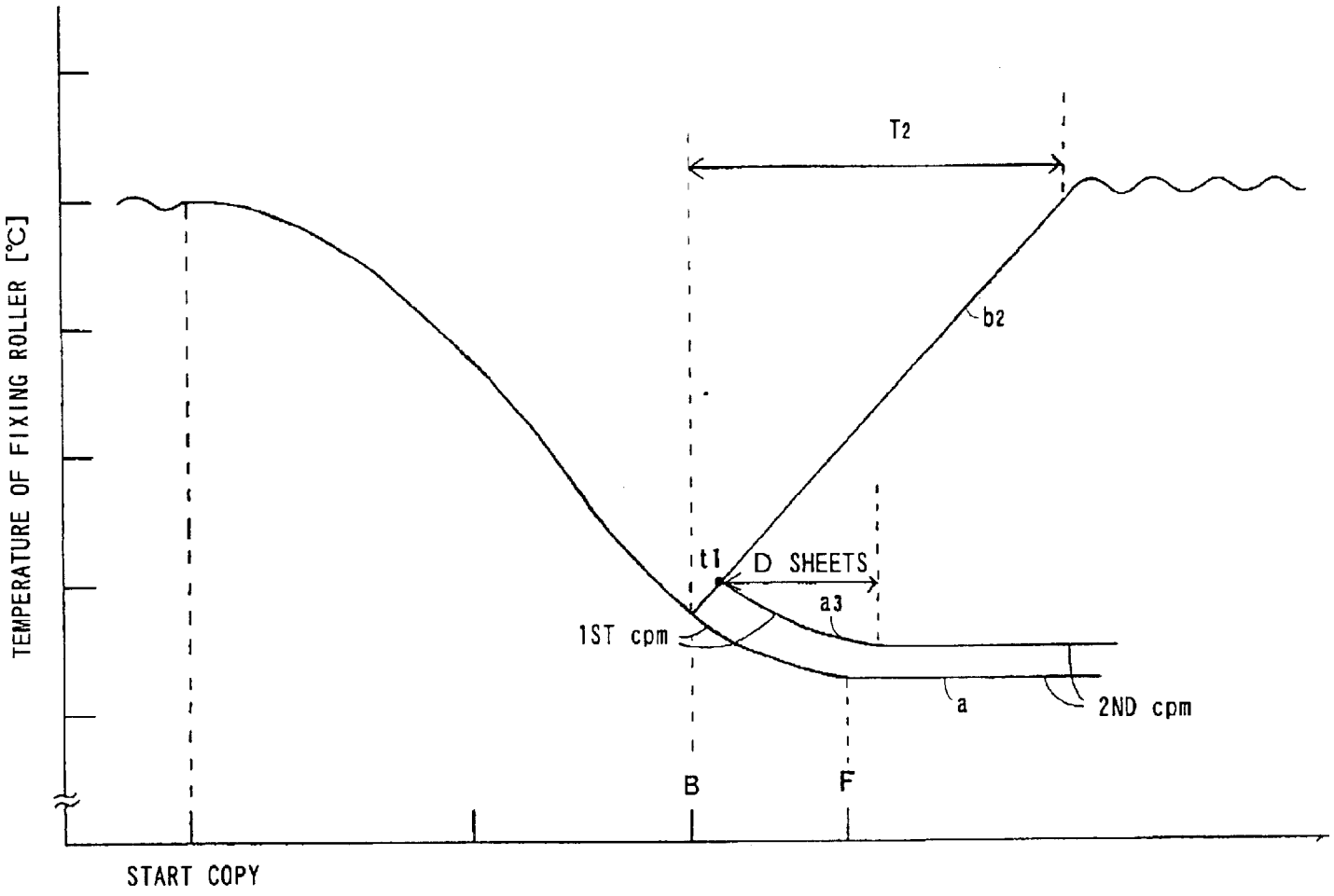
FIG. 6 is a diagram showing the change, with time, in surface temperature of the fixing roller according to the present embodiment.
Figure 7:
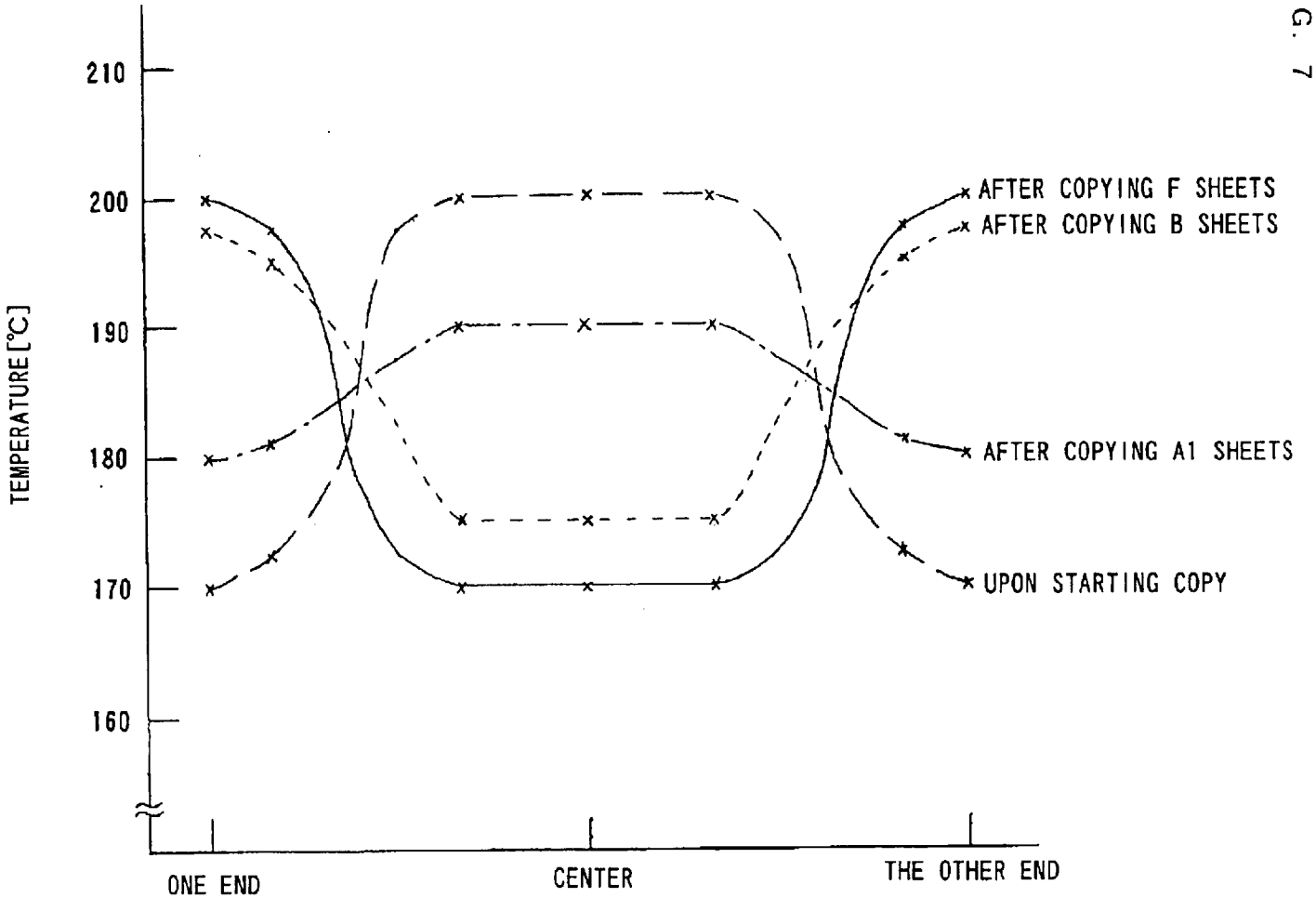
FIG. 7 is a diagram showing a distribution of the surface temperature of the fixing roller in the longitudinal direction according to the present embodiment.
Figure 8:
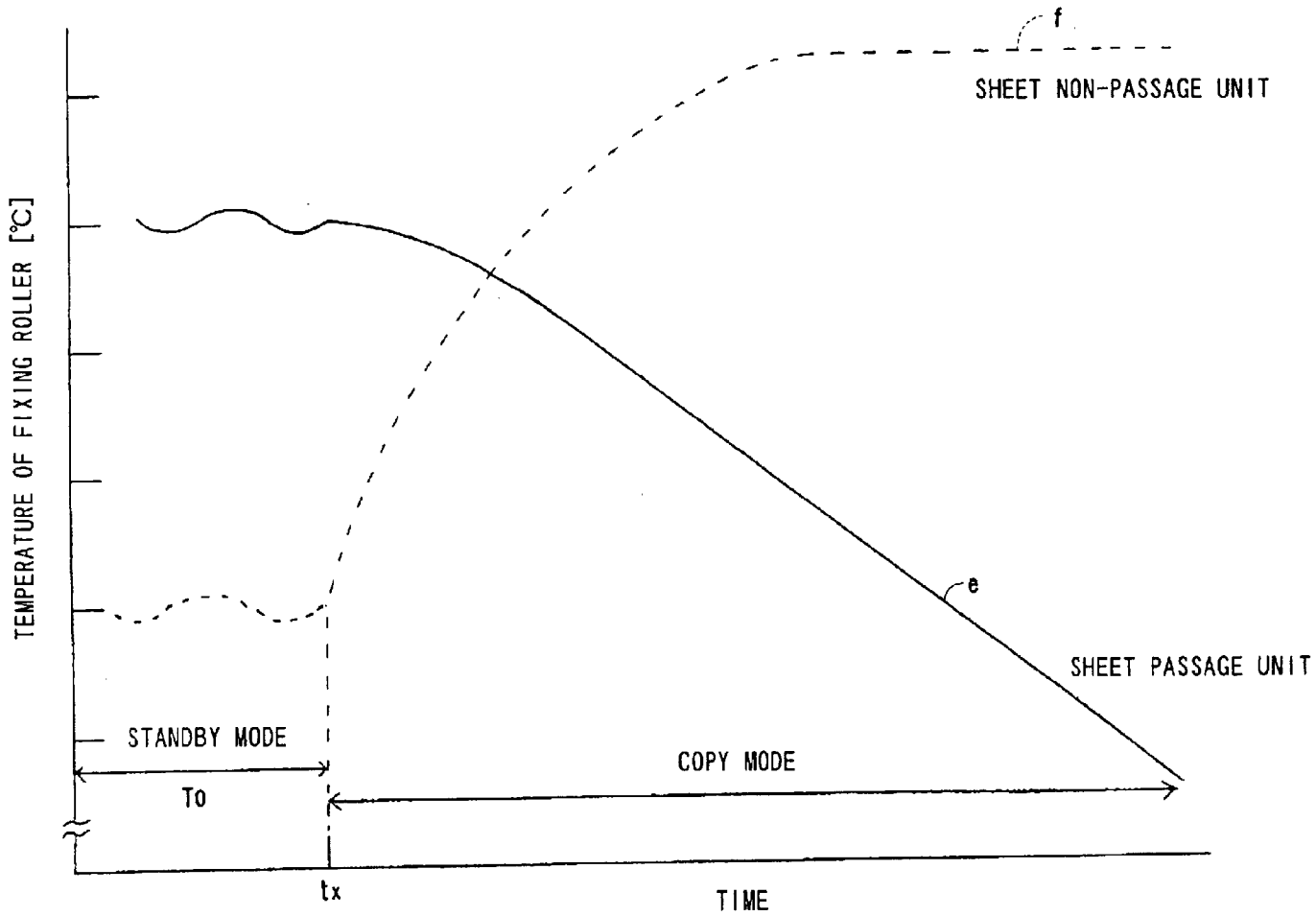
F I G. 8 PRIOR ART
FIG. 8 is a diagram showing change, with time, in surface temperature of the fixing roller in a conventional apparatus.

Next, a description is given of change in the surface temperature of the fixing roller when the copying speed is switched and controlled in the above manner with reference to FIGS. 5 to 7. FIGS. 5 and 6 are diagrams showing changes, with time, in the surface temperature of the fixing roller according to the present embodiment and, incidentally, in FIGS. 5 and 6, the axis of abscissa is time and the axis of ordinate is the surface temperature of the fixing roller. FIG. 7 shows a diagram showing the distribution of the surface temperature of the fixing roller in the longitudinal direction. As shown in FIG. 5, when the continuous copying operation starts at the first copying speed, the surface temperature in the center of the fixing roller begins to decrease. Then, in the case of continuously copying the sheets as it is, as shown by a curve a, the first copying speed is changed to be the second copying speed when the F (50) sheets are copied. A line shown by an alternate long and short line in the figure indicates a lower limit of the temperature at which it is capable of fixing to the recorded sheet. In the present embodiment, in the case of the continuous copying operation, a control operation for changing the first copying speed to the second copying speed is performed during the continuous copying operation so that the surface temperature of the fixing roller is prevented from becoming be the lower limit temperature or less. If the copying operation ends when the A1 (30) sheets are copied after the start of the copying operation, the surface temperature of the fixing roller is thereafter increased as shown by a curve b1, thereby returning to the standby mode. After the copying operation ends when the A1 (30) sheets are copied, then, a time of Ta passes, that is, the surface temperature of the fixing roller returns to the standby mode. And then, if the continuous copying operation starts, the surface temperature in the center of the fixing roller is reduced as shown by a curve a1. In this case, similarly to the curve a, the continuous copying operation is performed at the first copying speed up to the F (50) sheets. In the case of copying sheets sequent to the F sheets, the copying speed is switched to the second one from the first one. On the other hand, the copying operation is finished when the A1 sheets are copied, thereafter, before the time of Ta passes, that is, before the surface temperature of the fixing roller returns to the standby mode, for example, at a time of t1 in FIG. 5, the continuous copying operation starts and, then, the surface temperature of the fixing roller falls as shown by the curve a2. In this case, C (20) sheets are continuously copied at the first copying speed and, after the time of t1 at the time at which the C sheets are copied, the copying speed is changed to the second copying speed.

A curve a in FIG. 6 is similar to the curve a in FIG. 5. A curve b2 in FIG. 6 indicates the change in the surface temperature of the fixing roller when the copying operation ends after B (40) sheets are continuously copied. In this case, if a time of T2 (60 sec) passes after the end time of the continuous copying operation, the continuous copying operation can be performed at the first copying speed up to fifth sheet on the next continuous copying operation. However, if the continuous copying operation restarts before the time of T2 (60 sec) passes after the end time of the continuous copying operation, e.g., at a time of t1 in FIG. 6, the number of continuously copied sheets at the first copying speed is limited to D (10) and the copying speed of 11th and sequent sheets is switched to the second copying speed.

FIG. 7 is a diagram showing the distribution of the surface temperature of the fixing roller in the longitudinal direction. This figure indicates a measured result of the surface temperature of the fixing roller in the longitudinal direction when, actually, the sheets are continuously copied. As will be obviously understood in FIG. 7, since the heater heats the fixing roller at the start of the copying operation, the surface temperature in the center of the fixing roller is higher than that at the ends of the fixing roller. After the end time of the copying operation of A1 (30) sheets, in the distribution of the surface temperature of the fixing roller in the longitudinal direction, no remarkable difference of the temperature is caused between the center and the ends. After the end time of the copying operation of B (40) sheets, a difference of the temperature is caused between the center and the ends. Although a large difference of the temperature is caused after the end time of the copying operation of F (50) sheets, the temperature in this case is within the temperature range having no effect on the fixing performance, and the difference of the temperature is within approximately 30° C. The difference of the temperature within the foregoing cannot have any adverse effect on the fixing performance. Since the copying speed of 50 or more sheets is switched to the second copying speed, the difference in the surface temperature of the fixing roller cannot be further increased even if the 50 or more sheets are continuously copied.

According to the present embodiment, for example, if the continuous copying operation is performed once and it is subsequently performed again, the copying speed is switched, during the continuous copying operation at this time, from the first copying speed to the second copying speed at which the difference of the surface temperature of the fixing roller is within the allowable predetermined temperature range even in the case of the continuous copying operation, in accordance with the number of copied sheets at the previous time and the passing time after the end time of the copying operation. Thus, the fixing roller is prevented from becoming an abnormally high temperature which causes the high-temperature offset and from an abnormally low temperature which causes the defect of the fixing, and the copying operation is preferably executed.

Also, according to the present embodiment, since the difference of the surface temperature of the fixing roller in the longitudinal direction is prevented from being out of the allowable predetermined temperature range and the number of copied sheets at the copying speed such that the number of passing sheets is large can be increased, the copying time can be reduced as compared with the conventional apparatuses.

Further, according to the present embodiment, even if the copying machine can have only one heater for heating the fixing roller and only one temperature detecting sensor for detecting the surface temperature of the fixing roller in terms of costs, the high-temperature offset and the defect of fixing can be prevented and the continuous copying time can be reduced.

Incidentally, the present invention is not limited to the above-mentioned embodiment and can be variously modified within the range of its essentials. Although the above embodiment shows the case in which the sheet feed control unit can switch the copying speed at the two stages, the copying speed may be switched at three or more stages. Also, although the above embodiment shows the case in which the temperature detecting sensor is arranged in the center of the fixing roller, the temperature detecting sensor may be arranged at the end of the fixing roller. Further, although the present embodiment shows the case in which the image forming apparatus is a copying machine, the image forming apparatus of the present invention may be an electrostatic recording apparatus or the like. In addition, the present invention is not limited to the values in the table shown in FIG. 3.

As mentioned above, according to the present invention, based on the number of recorded materials upon the previous continuous image formation and the passing time from the previous end time of image formation, limited to a predetermined number of sheets is the first copying speed at which the number of recorded materials per unit time is large when the recorded materials pass through the fixing roller. If the number of sheets is over the limited number of sheets, the copying speed is changed to the second copying speed at which the number of sheets per unit time is small. Consequently, even if the image is continuously formed once, thus, the difference of the surface temperature of the fixing roller in the longitudinal direction is increased, and subsequently, the image is further continuously formed, the copying speed can be set so as to prevent the difference of the surface temperature of the fixing roller in the longitudinal direction from being out of the allowable predetermined temperature range. Accordingly, it is to provide an image forming apparatus capable of preventing the high-temperature offset and the defect of the fixing and of reducing the continuous copying time. The image forming apparatus of the present invention is suitable to be used for an apparatus in which, in particular, single temperature detecting means and single heating means are provided.

INDUSTRIAL APPLICABILITY

As described above, in the image forming apparatus of the present invention, by controlling the copying speed upon the continuous image formation at this time based on the number of passing recorded-materials upon the continuous image formation at the previous time and the passing time from the end time of the continuous image formation, the difference of the surface temperature of the fixing roller can be kept to be within the allowable range. Thus, the high-temperature offset and the defect of the fixing can be prevented and the continuous copying time can be reduced. Accordingly, the image forming apparatus of the present invention can be used for the copying machine, the electrostatic recording apparatus, and the like having the thermal fixing means.

What is claimed is:

1. An image forming apparatus including thermal fixing means having a fixing roller and heating means for heating said fixing roller, temperature detecting means for detecting a temperature of said fixing roller, and temperature control means for controlling power supplied to said heating means and controlling the temperature of said fixing roller based on a signal from said temperature detecting means, characterized by comprising:

number of sheets storing means for storing the number of passing sheets upon a previous continuous-image-formation;

counter means for counting a passing time from the end time of the previous continuous-image-formation;

control means for, upon said continuous-image-formation, and based on the number of sheets stored by said number of sheets storing means and the time counted by said counter means, limiting the number of sheets image-formed at a first copying speed, at which the number of passing sheets per unit of time is large, to a predetermined number of sheets, and for, when the number of sheets is over the predetermined number of sheets, changing said first copying speed to a second copying speed at which the number of passing sheets per unit of time is small; and storing means for previously storing said predetermined number of sheets in a table format so that as the number of passing sheets stored by said number of sheets storing means is smaller, said predetermined number of sheets is larger and, as the passing time counted by said counter means is longer, said predetermined number of sheets is larger, wherein said control means refers to said predetermined number of sheets stored in the table format by said storing means and changes the copying speed from said first copying speed to said second copying speed.

2. An image forming apparatus according to claim 1, characterized in that said predetermined number of sheets is determined so that a difference of temperature of said fixing roller in the longitudinal direction is prevented from being out of an allowable predetermined temperature range, and the number of image formed sheets is as large as possible at said first copying speed.

3. An image forming apparatus according to claim 1, characterized in that said temperature detecting means comprises only a single temperature detecting means or said heating means comprises only a single heating means.

4. An image forming apparatus according to claim 1, characterized in that the number of passing sheets stored by said number of sheets storing means is the number of passing sheets of a recorded material which passes through said thermal fixing means.

5. An image forming apparatus according to claim 2, characterized in that said temperature detecting means comprises only a temperature detecting means or said heating means comprises only a single heating means.

6. An image forming apparatus of claim 2, characterized in that the number of passing sheets stored by said number of sheets storing means is the number of passing sheets of a recorded material which passes through said thermal fixing means.

7. An improved image forming apparatus of the type that includes thermal fixing means having a fixing roller and heating means for heating said fixing roller, temperature detecting means for detecting a temperature of said fixing roller, and temperature control means for controlling power supplied to said heating means and controlling the temperature of said fixing roller based on a signal from said temperature detecting means, wherein the improvement comprises:

number of sheets storing means for storing the number of passing sheets upon a previous continuous-image-formation;

counter means for counting a passing time from the end time of the previous continuous-image-formation;

control means for, upon said continuous-image-formation, and based on the number of sheets stored by said number of sheets storing means and the time counted by said counter means, limiting the number of sheets image-formed at a first copying speed, at which the number of passing sheets per unit of time is large, to a predetermined number of sheets, and for, when the number of sheets is over the predetermined number of sheets, changing said first copying speed to a second copying speed at which the number of passing sheets per unit of time is small; and storing means for previously storing said predetermined number of sheets in a table format so that as the number of passing sheets stored by said number of sheets storing means is smaller, said predetermined number of sheets is larger and, as the passing time counted by said counter means is longer, said predetermined number of sheets is larger, wherein said control means refers to said predetermined number of sheets stored in the table format by said storing means and changes the copying speed from said first copying speed to said second copying speed, and wherein said temperature detecting means has a single temperature detector.

8. An image forming apparatus including thermal fixing means having a fixing roller and heating means for heating said fixing roller, temperature detecting means for detecting a temperature of said fixing roller, and temperature control means for controlling power supplied to said heating means and controlling the temperature of said fixing roller based on a signal from said temperature detecting means, the image forming apparatus comprising:

number of sheets storing means for storing the number of passing sheets upon a previous continuous-image-formation;

counter means for counting a passing time from the end time of the previous continuous-image-formation;

control means for, upon continuous-image-formation, and based on the number of sheets stored by said number of sheets storing means and the time counted by said counter means, limiting the number of sheets image-formed at a first copying speed, at which the number of passing sheets per unit of time is large, to a predetermined number of sheets, for deciding said predetermined number of sheets so that as the number of passing sheets stored by said number of sheets storing means is smaller, said predetermined number of sheets is larger and, as the passing time counted by said is longer, said predetermined number of sheets is larger, and for, when the number of sheets is over said limited number of sheets, changing said first copying speed to a second copying speed at which the number of passing sheets per unit of time is small.

* * * * *